US006871402B2

(12) United States Patent
Bader et al.

(10) Patent No.: US 6,871,402 B2
(45) Date of Patent: Mar. 29, 2005

(54) ELECTRICALLY DRIVEN HAIR REMOVAL DEVICE

(75) Inventors: Raoul Bader, Mainz (DE); Mattias Gradl, Sesslach (DE); Sebastian Hottenrott, Idstein (DE); Peter Junk, Seelenberg (DE); Christof Kleemann, Eschborn (DE); Michael Meiss, Friedberg (DE); Uwe Neumann, Wiesbaden (DE); Michael Odemer, Niddatal-Assenheim (DE); Andreas Rehklau, Coburg (DE); Jens Storkel, Frankfurt (DE); Petri Toivanen, Kopenhagen (DE); Till Winkler, Kronberg (DE); Jurgen Wolf, Kriftel (DE)

(73) Assignee: Braun GmbH, Kronberg ( * ) Notice: Subject to any disclaimer, the term of this patent is extended or adjusted under 35 U.S.C. 154(b) by 9 days.

(21) Appl. No.: 10/311,044

(22) PCT Filed: Oct. 13, 2001

(86) PCT No.: PCT/EP01/11863

§ 371 (c)(1),
(2), (4) Date: May 7, 2003

(87) PCT Pub. No.: WO02/34481

PCT Pub. Date: May 2, 2002

(65) Prior Publication Data

US 2003/0167638 A1 Sep. 11, 2003

(30) Foreign Application Priority Data

Oct. 20, 2000 (DE) ..... 100 52 127

(51) Int. Cl.[7] ..... B26B 19/46
(52) U.S. Cl. ..... 30/43.92; 30/537; 362/115
(58) Field of Search ..... 362/115; 30/43.92, 30/34.05, 537

(56) References Cited

U.S. PATENT DOCUMENTS

| | | | | | |
|---|---|---|---|---|---|
| 2,595,287 | A | * | 5/1952 | Perry | 362/115 |
| 2,965,748 | A | * | 12/1960 | Bonanno | 362/115 |
| 3,473,106 | A | * | 10/1969 | Grabl | 323/277 |
| 3,604,915 | A | * | 9/1971 | Wahl | 362/115 |
| 3,770,950 | A | | 11/1973 | Brenneman et al. | 362/115 |
| 4,094,062 | A | * | 6/1978 | Papanikolaou | 30/34.05 |
| 4,719,698 | A | * | 1/1988 | Ninomiya et al. | 30/43.6 |
| 4,733,468 | A | * | 3/1988 | Zadro | 30/34.05 |
| 5,065,515 | A | * | 11/1991 | Iderosa | 30/140 |
| 5,299,104 | A | * | 3/1994 | Parmentier | 362/115 |
| 5,582,476 | A | * | 12/1996 | Hansen | 362/115 |
| 5,606,798 | A | * | 3/1997 | Kelman | 30/41.5 |
| 5,632,087 | A | * | 5/1997 | Motohashi et al. | 30/43.92 |
| 5,794,342 | A | * | 8/1998 | Davey | 30/45 |
| 5,920,988 | A | * | 7/1999 | Momose | 30/41 |
| 5,946,806 | A | * | 9/1999 | Watanabe et al. | 30/43.92 |
| 5,970,616 | A | * | 10/1999 | Wahl et al. | 30/216 |
| 5,993,440 | A | * | 11/1999 | Ghassemi | 606/9 |
| 6,073,348 | A | * | 6/2000 | Shiba | 30/34.1 |
| 6,227,676 | B1 | * | 5/2001 | Sneddon | 362/115 |
| 6,460,251 | B1 | * | 10/2002 | Orloff | 30/41.7 |
| 6,533,775 | B1 | * | 3/2003 | Rizoiu | 608/9 |

FOREIGN PATENT DOCUMENTS

| | | |
|---|---|---|
| DE | 72 23 118 | 12/1972 |
| DE | 23 49 393 | 4/1975 |
| DE | 77 28 867 | 2/1978 |
| DE | 79 36 716 | 4/1980 |
| DE | 196 01 780 C1 | 6/1997 |
| EP | 0 069 468 | 1/1983 |
| GB | 2 100 647 A | 1/1983 |

* cited by examiner

*Primary Examiner*—Charles Goodman
(74) *Attorney, Agent, or Firm*—Fish & Richardson P.C.

(57) ABSTRACT

An electrically operated hair removing device, comprising a housing, an operating system connected to the housing for clipping and/or plucking hair, the system having at least two operating elements which are movable relative to one another and at least one of which is driven, and an illumination device for illuminating the operating system, the illumination device being integrated in at least one of the operating elements.

16 Claims, 5 Drawing Sheets

Fig. 1
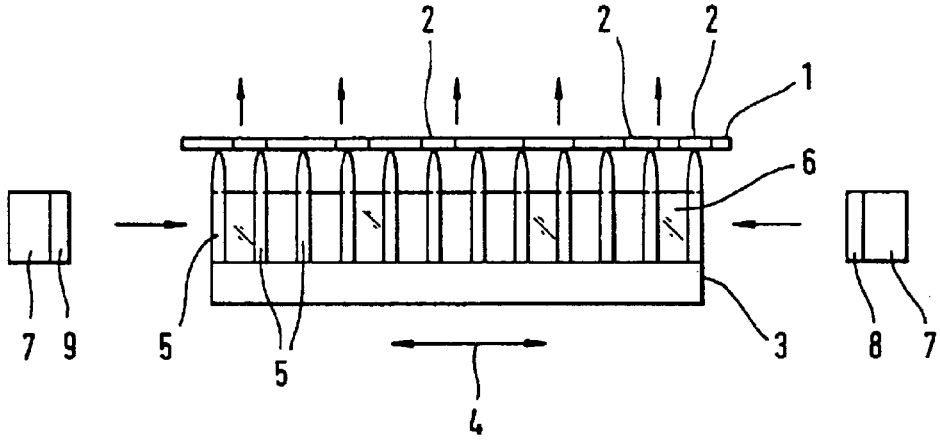
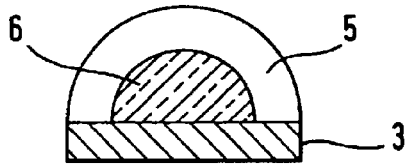
Fig. 1A

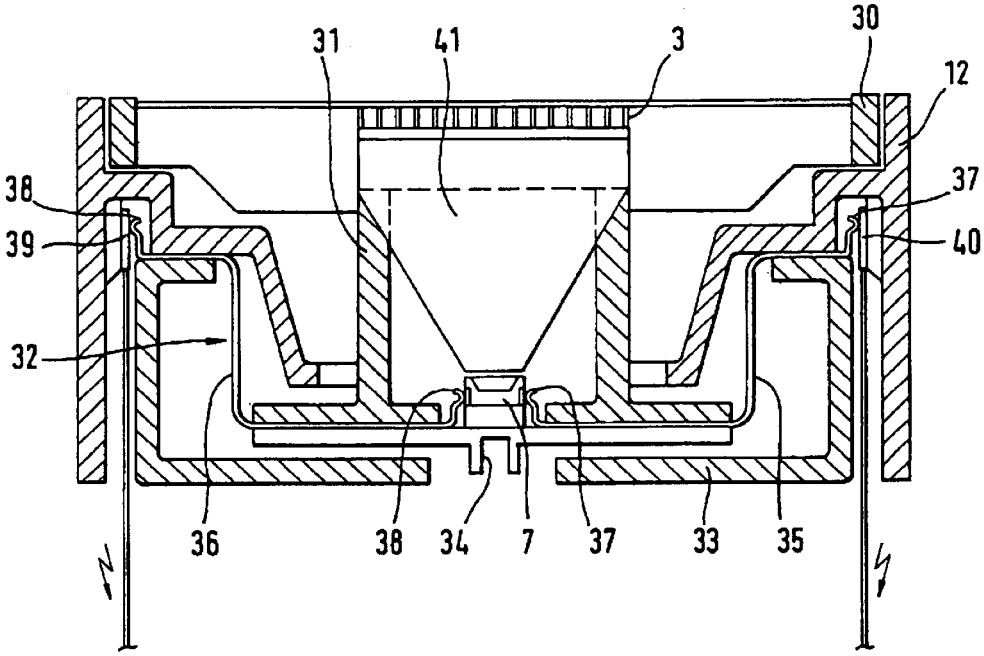
Fig. 3
Fig. 3A
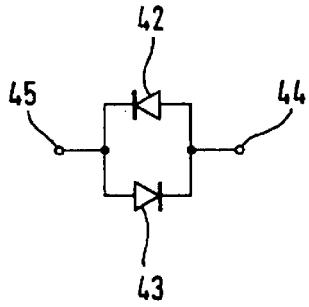

ELECTRICALLY DRIVEN HAIR REMOVAL DEVICE

This application is a 371 of PCT/EP01/11863 filed on Oct. 13, 2001 which claims priority to German Application No. 10052127, filed on Oct. 20, 2000.

TECHNICAL FIELD

The invention relates to an electrically operated hair removing device.

Shavers, hair/beard clippers and epilation devices are examples of electrically operated hair removing devices. EP 0 069 468 A1 discloses a dry electric shaver that has a housing and a lower blade which is driven in translatory oscillating fashion and is situated below a clipping foil. Within the housing, an electrical lamp is arranged in a region below the lower blade that is adjacent to the clipping head, which lamp transilluminates both the lower blade and the clipping foil and thus illuminates the skin location to be shaved. The electrical light in this shaver is significantly darkened both by the lower blade and by the clipping foil, which significantly reduces the illumination effect. For this reason, a further embodiment of EP 0 069 468 A1 has an additional illumination arrangement outside the clipping head, which in turn is associated with an additional outlay.

Therefore, the invention is based on the object of improving an electrically operated hair removing device of the type specified above to the effect of ensuring the best possible illumination of the actual operating area of the device in conjunction with a low structural outlay.

SUMMARY OF THE INVENTION

This object is achieved according to the invention by means of the characterizing features of claim 1.

The invention features an electrically operated hair removing device comprising a housing, an operating system connected to the housing for clipping and/or plucking hair, the system having at least two operating elements which are movable relative to one another and at least one of which is driven, and an illumination device for illuminating the operating system, the illumination device being integrated in at least one of the operating elements.

In one preferred embodiment the required light is generated directly at the operating area of the device or is at least directly available there. This not only enables optimum illumination of the operating area, but also affords the possibility of using corresponding light signals, which can be generated for example by flashing, altering the brightness, changing the color and the like, to indicate operationally relevant properties or information to the user, without the latter having to avert his gaze from the actual operating area. Thus, by way of example, information about the contact pressure on the skin, the remaining rechargeable battery capacity or the like can be indicated to the user by corresponding light signals.

Such visualization of system properties directly in the user's field of view decisively increases the operational convenience and the utility value of such a device. A useful condition for such a type of indication, however, is a particularly reliable and complete transmission of the light signal into the user's field of view.

The illumination directly at the operating elements also can be used to indicate possible contamination or wear of said elements.

In a preferred embodiment of the invention, the illumination device is provided in at least one moved operating element, in particular in a driven lower blade or a driven epilation roller, as a result of which the dynamics of the hair removing device can be represented to the user of said device in a particularly noticeable manner.

In order to obtain an intense system illumination, the illumination device has at least one optical wave guide, which is arranged on one operating element which is movable relative to another operating element and/or to the housing, and at least one light source, which is arranged on a housing section and whose light beams couple into the optical wave guide. If the light beams of the light source are coupled contactlessly via an air gap, the illumination of driven components can be implemented in a simple manner. Of course, the light source can also be arranged directly in at least one of the operating elements.

In an advantageous manner with regard to energy consumption, structural volume and luminous intensity, the light source is formed by at least one light-emitting diode; especially as light-emitting diodes are particularly suitable for pulsating operation and for the representation of different colors.

Particularly good visualization of the mechanical operating system with its operating elements that are moved relative to one another can be obtained with a low structural outlay if the illumination device emits stroboscopically pulsed light signals. In this case, an ideal possibility for representing the system dynamics is provided when the frequency of the light signals about +/−20% of the frequency of the movement of the operating elements. In this way, it is possible to generate still or, alternatively, very slowly moving images of a highly dynamic or high-frequency movement.

In an advantageous embodiment of the invention, the operating system is a clipping system with a clipping foil and a lower blade which is movable relative to said system and which is driven in rotary or translatory fashion, or it comprises two clipping combs which are movable relative to one another. In a further advantageous embodiment of the invention, the operating system is an epilation system with tweezers which are movable relative to one another.

An ideal possibility for indicating possible wear of the operating system is provided if the illumination device or at least part of it has defined reproducible aging properties which are coordinated with the wear behavior of the device.

Further aims, features, advantages and possible applications of the present invention emerge from the following description of the exemplary embodiments. In this case, all the features which are described or represented pictorially form the subject matter of the present invention by themselves or in any desired combination, and also independently of their combination in the claims or the reference back thereof.

BRIEF DESCRIPTION OF THE DRAWINGS

The drawing illustrates a plurality of embodiments of the invention, where

FIG. 1A shows a side view of the lower blade in accordance with FIG. 1,

FIG. 3 shows a further embodiment of a clipping head.

FIG. 3A shows an embodiment of a light source.

DETAILED DESCRIPTION

Figure 2B:
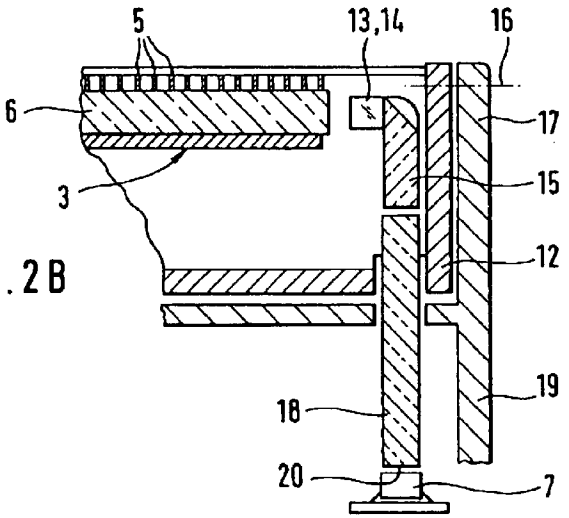
FIG. 2B shows a front view of a multiple clipping head in accordance with FIG. 2A

FIG. 1 shows a schematic sketch of a detail from a clipping head of an electric shaver. This clipping head essentially comprises, in a manner known per se, a clipping foil 1 with openings 2, which is stretched over a lower blade 3 which, as is indicated by the arrow 4, is driven in translatory oscillating fashion in a suitable manner. The lower blade 3 is designed as a so-called blade block with a multiplicity of blades 5 arranged in parallel in a row next to one another. The blade block or the blades 5 are under elastic prestress at the clipping film 1, so that hairs that are threaded into the openings 2 are clipped off between the hole edge of the corresponding opening 2 and the blade 5, whose oscillation amplitude is greater than the extent of the openings 2.

As can be gathered from FIG. 1A, in particular, the blades 5 have approximately the contour of half an annulus. An optical wave guide 6 having approximately a semicircular cross section is led through the blades 5. Said wave guide extends over the entire length of the lower blade 3.

Situated laterally with respect to the lower blade 3, opposite the end faces of the optical wave guide 6, is a respective light source 7, which is fixed to the clipping head housing (not illustrated). Arranged between the respective light source 7 and the optical wave guide 6 is a respective color filter 8 and 9 with a mutually different color, in order to be able to couple light beams with two different colors into the optical wave guide 6. The light sources 7 are preferably embodied as light-emitting diodes and (not illustrated in the drawing) are connected to a current source via a signal generator. When using LEDs in corresponding colors as light sources, it goes without saying that the color filters can be omitted.

The light coupled in via the end faces of the optical wave guide 6 can then emerge between the blades 5 and is on the one hand visible to the user externally through the openings 2 and, on the other hand, the skin area to be shaved can be illuminated. The dynamics of the clipping system can be visualized in a very impressive manner by virtue of the fact that the light sources 7 are operated stroboscopically, i.e. are switched on and off in a flashlight-like manner, in a suitable relation to the oscillation frequency of the lower blade.

The stroboscopic effect then makes it possible to generate for the user a still image of the clipping system, for example, if the frequency of the light signals corresponds exactly to the oscillation frequency of the clipping system or to an integer multiple or to an integer part of the oscillation frequency. By contrast, if the frequency of the light signals deviates from the oscillation frequency of the clipping system by a certain, not all that large, difference within a specific range of, for example +/−20% of the oscillation frequency, then a pictorial representation of the lower blade which shows a slow sideward movement in one oscillation direction or the other can be achieved for the user. A corresponding variation of the frequency of the light pulsation therefore makes it possible to indicate specific operating states or properties of the shaver to the user.

Thus, by way of example, one indication concept can provide for a still image of the clipping system to be generated for the user whenever at least one system parameter, such as for example degree of contamination, rechargeable battery or battery charge or the like, is not optimal. By contrast, a clipping system image moving slowly in the oscillation direction is indicated if the system parameter or system parameters are in a state that is optimal or still classified as sufficient.

By way of example, if the contamination state of the shaver is to be indicated by the stroboscopic effect, then the light source 7 is driven with a frequency which deviates by a specific amount Δ from the oscillation frequency of the clipping system when the shaver is fully cleaned. This deviation Δ is progressively reduced to zero with increasing contamination of the clipping system through use. A still image of the clipping system then signals to the user that he must now perform a cleaning process. This deviation Δ can be controlled for example by means of a counting device—known per se—for the cutting events that take place.

An item of information for the user can also be indicated, of course, by altering the color of the illumination. For this purpose, by way of example, the light sources with the different color filters or light-emitting diodes of a corresponding color can be operated alternately; however, it is also possible, by means of corresponding simultaneous driving, to generate a mixture of colors or else to represent a continuous color alteration over the entire clipping head length.

Figure 2C:
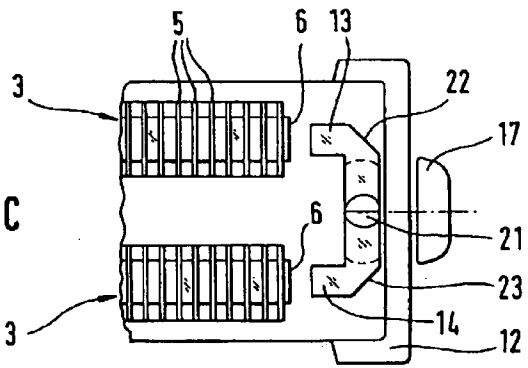
FIG. 2C shows a plan view of a multiple clipping head in accordance with FIG. 2A or 2B
Figure 2A:
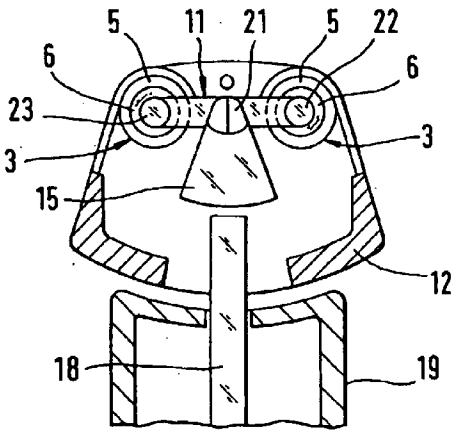

The double clipping head illustrated in FIG. 2A–2C has two lower blades 3, which are provided with a multiplicity of blades 5 and which, as already explained with reference to FIG. 1, are driven in oscillating fashion in a manner pressed onto a clipping foil (not illustrated). A central clipper for clipping longer hairs and/or hair on the skin can also additionally be arranged between the two lower blades 3 in a manner known per se, which central clipper is composed of two comb-like blades, one blade of which is driven in oscillating fashion; as a result, a so-called triple clipping head would then be formed.

Integrated in both lower blades 3 are respective optical wave guides 6 which extend over the entire length thereof. Arranged in front of at least one end side of the respective optical wave guides 6 is an optical wave guide fork 11 fixed to the clipping head housing 12. In this case, the ends 13 and 14 of said optical wave guide fork 11 lie directly opposite the end side of a respective optical wave guide 6, so that light can be coupled into the optical wave guides via them. The third end 15 of the optical wave guide fork 11 is designed in the form of a circle sector with a downwardly expanding cross section and is situated with its arcuate termination opposite the end side of a further optical wave guide 18.

The clipping head housing 12 is mounted in the clipping head holder 17 such that it can pivot about the axis 16. The optical wave guide 18 is fixed in the shaver housing 19 and projects upward out of the latter into the clipping head housing 12. Arranged directly in front of the end side 20 of the optical wave guide 18, said end side being opposite to the optical wave guide fork 11, is a light source 7 whose light beams couple directly into the optical wave guide 18. The angle between the limbs of the circle sector corresponds to the maximum pivoting angle of the clipping head housing 12 relative to the shaver housing 19 or the clipping head holder 17. The formation of the end 15 of the optical wave guide fork 11 in the form of a circle sector ensures that light from the light source 7 or the optical wave guide 18 can be coupled into the optical wave guide fork 11 in every pivoting position of the clipping head housing 12 relative to the shaver housing 19. The light fed into the optical wave guide fork 11 at the end 15 is split at the junction 21 into two components that are conducted in each case in mutually opposite directions. These two partial light fluxes are then deflected again by 90° at the respective deflection point 22 and 23 and they subsequently emerge at the ends 13 and 14, respectively, of the optical wave guide fork 11.

The use of the optical wave guide fork 11 means that only one light source 7 is necessary for illuminating two lower blades 3. In this case, the light source 7 can also be arranged directly on the printed circuit board of the shaver, which saves an electrical line into the clipping head. This is advantageous particularly when the clipping head is intended to be washable.

In the case of a clipping head that is not illustrated in the drawing, it is provided that, in addition to the oscillation of the lower blades 3, the clipping head housing 12 and thus the clipping foil also move in oscillating fashion in a push-pull manner with respect to the movement of the lower blade; in other words, the clipping head housing 12 can both be pivoted about the axis 16 and be driven in an oscillating manner in the longitudinal direction. In such an embodiment, the use of the optical wave guide fork 11 advantageously affords the possibility of the light source 7 being situated on a stationary component, namely the printed circuit board, rather than on a driven component.

In order to be able to represent different colors, it is possible to provide the ends 13 and 14 with different color filters. If such an optical wave guide fork is used on both sides of the lower blades 3, then at least four different colors can be represented in the optical wave guides 6 of the lower blades with a low outlay.

FIG. 3 shows a clipping head embodiment in which the light source 7 is arranged on a moved part of the clipping drive system. The clipping head comprises a clipping foil 1, which is held in an interchangeable frame 30 in a manner known per se, which frame is in turn fixed to the clipping head housing 12. The lower blade/blades 3 receives the blade head carrier 31, which is connected to the housing section 33 via the oscillating bridge 32. On the side opposite to the lower blade 3, the blade head carrier 31 is provided with a driver groove 34, which serves to receive a drive eccentric (not illustrated in the drawing), a drive crank or the like. An oscillatory system which is movable in oscillatory fashion in the longitudinal direction of the lower blades 3 is thereby formed in conjunction with the leaf-spring-like sections 35, 36 of the oscillating bridge 32 which act as articulated joints and are flexible in the oscillation direction.

Electrical lines 37 and 38, which connect the light source 7 to the electrical contact-making points 39, 40, run along the sections 35, 36 of the oscillating bridge 32. In the case of an oscillating bridge made of plastic, the electrical lines 37 and 38 can be integrated into the material of the oscillating bridge; in the exemplary embodiment, two metallic oscillating bridge halves which are electrically insulated from one another are used, which then themselves form the electrical lines. The electrical contact-making points 39, 40 are connected (not illustrated in the drawing) to a current source via a signal generator. An optical wave guide 41 runs between the lower blade(s) 3 and the light source 7, which optical wave guide is connected to the lower blade(s) 3 and expands from the light source 7 in the direction of the lower blades 3 in a funnel-shaped manner to approximately the entire lower blade length. Consequently, the clipping head can be illuminated over its entire extent by a light source of comparatively small dimensions.

FIG. 3A shows a light source formed by two light-emitting diodes 42, 43, connected back-to-back. The use of such a light source enables illumination independently of the direction of current flow; if a positive electrical voltage is applied to the terminal 44, the light-emitting diode 42 illuminates, whereas if a positive electrical voltage is applied to the terminal 45, the light-emitting diode 43 is switched on. If a light source in accordance with FIG. 3A is used in a clipping head embodiment in accordance with FIG. 3, the terminals 44 and 45 being connected to the electrical lines 37 and 38, and if light-emitting diodes 42, 43 with a different color are used, then illumination of the clipping head with two different colors can be realized with just two electrical current feeds. This reduces the assembly outlay, in particular.

Figure 4:
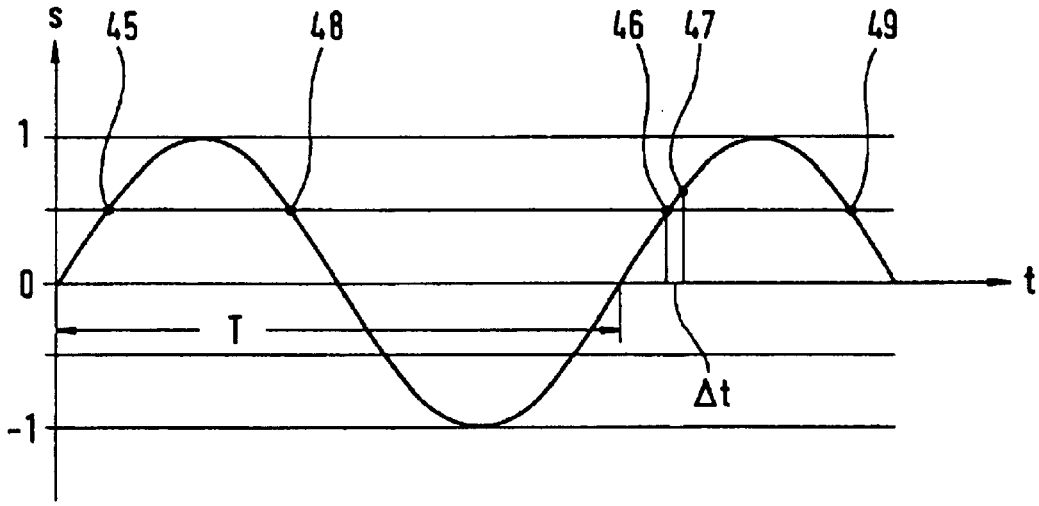
FIG. 4 shows a representation of the movement profile of a driven lower blade.

FIG. 4 shows the movement profile of a lower blade 3 driven in oscillatory fashion over 1.5 oscillation periods or 1.5 crank or eccentric revolutions. Each point in time t is assigned a specific angular position of the drive motor. If the lower blade 3 is exposed to a flash for the first time at the operating point 46, then the representation of a still lower blade 3 can be generated when the next flash is effected at the operating point 47, that is to say after an oscillation period t. By contrast, if the next flash is effected at the operating point 48, that is to say after an oscillation period $T+\Delta t$, then it is possible to represent virtually a "drifting movement" of the driven lower blade 3. The speed of the "drifting" virtual image is dependent on the magnitude of $\Delta t$.

As a result of the sinusoidal movement of the lower blade 3, through which the latter crosses every point on its movement path at least twice per revolution, it can also be exposed to a flash twice per revolution without an optically blurred representation of its movement occurring. This applies to every angular position except for the two extrema, which are traversed only once per revolution. The time interval between the additional flash and the regular flash is dependent on the phase angle of the regular flash. It is exactly ½T in the central position and decreases to zero in the extreme positions. If the lower blade 3 is to be represented in moving (drifting) fashion, then the phase angle of the regular flash must change permanently with regard to the instantaneous location of the lower blade 3, and thus so too must the required time interval. An electronic controller can calculate this, however, when it knows as a basis a specific position of the lower blade 3 as reference. An additional flash results in a doubling of the light coupled in. Moreover, the phase angle of the flashes can be used in a targeted manner as indication means. If an optically still image of the lower blade 3 is to be generated, then it can be exposed to a flash at the operating points 46, 49, 47 and 49'.

The electronic controller can also control the flash duration (variable in that case) in such a way that a somewhat longer light signal is generated at low speed of the lower blade 3 that is driven in oscillatory fashion, that is to say near the turning points, than at higher speed. This results in a high illumination performance without the risk of optical blurring of the image that is visible to the user. Moreover, synchronism with the present rotational speed or speed of the clipping system can be obtained through a correlation of the light signal generator with the rotational speed of the electrical drive motor.

Figure 5:
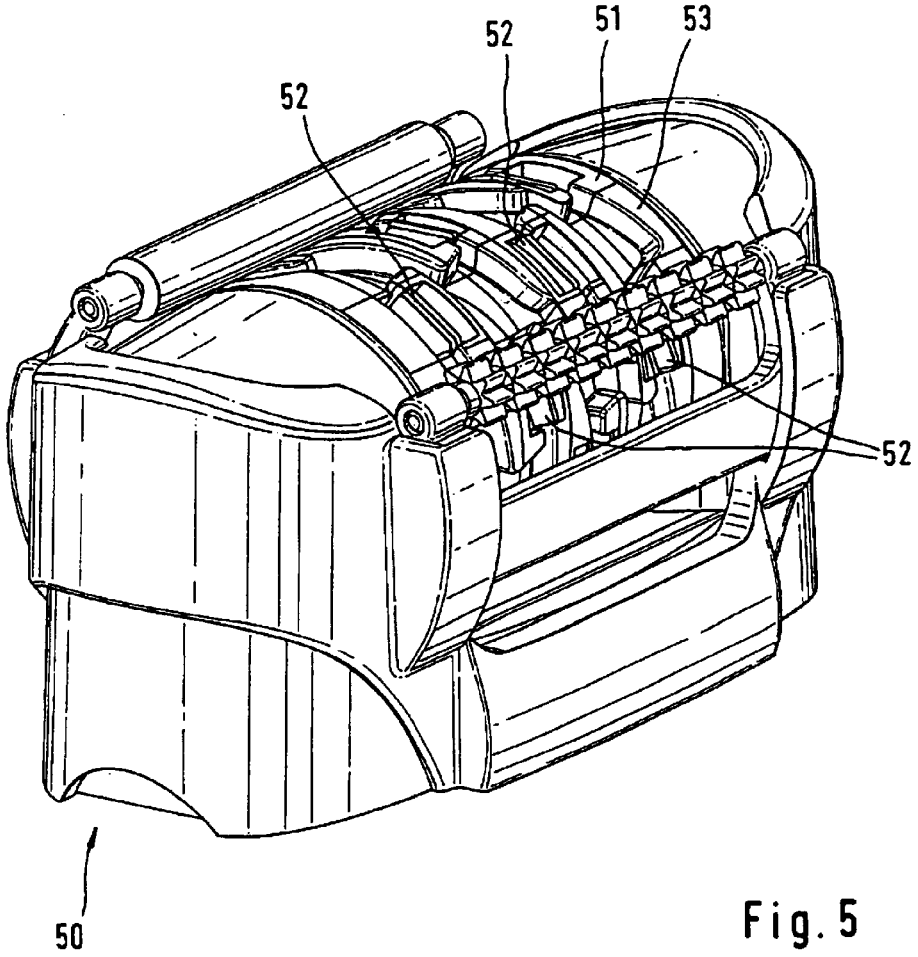
FIG. 5 shows the epilating bead of an electric epilation device.

FIG. 5 shows the plucking head 50 of an electrical epilation device, in which an epilation cylinder 51 driven in rotary fashion is mounted. A multiplicity of pairs of tweezers 52 are arranged in distributed fashion on the periphery of the epilation cylinder 51 and, actuated during the rotary movement of the epilation cylinder, open and close by means that are known per se and are not illustrated for the sake of clarity, in order to grasp, clamp and pull out body hairs when the epilation cylinder 51 is guided over a skin section to be epilated.

The epilation cylinder 51 has a plurality of optical wave guide strips 53 which are distributed on the periphery and into which light can be fed by means of a light source (not illustrated in the drawing). In this case, too, the light source is operated in stroboscopically flashing fashion, so that, given corresponding coordination between the flash frequency of the light source and the rotational frequency of the epilation cylinder 51, it is possible to represent a virtually still or very slowly moving image of the epilation cylinder, including the pairs of tweezers.

In this case, the stroboscopic effect can indicate, by way of example, a battery capacity nearing its end in that the flash frequency of the light source deviates by a specific amount $\Delta$ in the case of maximum battery capacity, while it gradually approaches the rotational frequency of the epilation cylinder as the battery capacity decreases, by then, upon reaching a limit value of the battery capacity, the flash frequency corresponds to the rotational frequency and a virtually still epilation cylinder 51 is this represented. The image of a "still" epilation cylinder that is thereby virtually represented to the user signals to said user that he should soon exchange or recharge the battery.

By means of the illumination of the clipping head or of the epilation cylinder, not only can the skin area that is to be shaved or epilated be illuminated, but dirt particles, hairs or hair dust accumulations that may have been deposited are clearly indicated to the user.

The stroboscopic illumination of the clipping head or of the epilation cylinder makes it possible to demonstrate to the user, in a simple and particularly clear manner, the usability of the device at the beginning of each use of said device. For this purpose, the following process proceeds automatically each time the device is switched on: firstly, the light signals pulsate at the lowest permitted frequency; this frequency is then gradually increased up to the maximum permissible frequency. If the user can see an optically still image of a clipping element or of the epilation cylinder during this process, then the device is in order at least in terms of rotational speed.

Instead of an electrically operated light source, a so-called light collector which collects ambient light and outputs it in focused fashion over a light emission area which is small in comparison with the total surface area, then this firstly simplifies the structural outlay and reduces the energy consumption; secondly, this effects automatic regulation of the illumination intensity of the hair removing device in comparison with the intensity of the ambient illumination.

What is claimed is:

1. An electrically operated hair removing device, comprising an operating system connected to said housing for clipping and/or plucking hair, said system having a housing, at least two operating elements which are movable relative to one another and at least one of which is driven and an illumination device for illuminating the operating system, said illumination device being integrated in at least one of the operating elements.

2. The device as claimed in claim 1, wherein the illumination device is provided in a moved operating element.

3. The device as claimed in claim 1 or 2 the illumination device has at least one optical wave guide.

4. The device as claimed in claim 1, wherein the illumination device comprises at least one optical wave guide, which is arranged on one operating element which is movable relative to another operating element and/or to the housing, and at least one light source, which is arranged on a housing section and whose light beam couples into the optical wave guide.

5. The device as claimed in claim 4, wherein the light beams of the light source is coupled contactlessly via an air gap.

6. The device as claimed in claim 4 wherein the light source is formed by at least one light-emitting diode.

7. The device as claimed in claim 1, wherein the illumination device emits stroboscopically pulsed light signals.

8. The device as claimed in claim 1, wherein at least two different colors can be represented by means of the illumination device.

9. The device as claimed in claim 1, wherein the operating system is a clipping system with a clipping foil and a lower blade which is movable relative to said system.

10. The device as claimed in claim 9, wherein the lower blade is driven in rotary fashion.

11. The device as claimed in claim 9, wherein the lower blade is driven in translatory fashion.

12. The device as claimed in one of claim 1, characterized in that the operating system is a clipping system with two clipping combs which are movable relative to one another.

13. The device as claimed in one of claim 1, characterized in that the operating system is an epilation system with tweezers which are movable relative to one another.

14. The device as claimed in claim 1, characterized in that the illumination device or at least part of it has defined reproducible aging properties which are coordinated with the wear behavior of the device.

15. The device as claimed in claim 1, characterized in that a light collector is used as the light source.

16. The device as claimed in claim 5, characterized in that the light source is formed by at least one light-emitting diode.

* * * * *